US010852004B2

(12) United States Patent
Park et al.

(10) Patent No.: US 10,852,004 B2
(45) Date of Patent: Dec. 1, 2020

(54) SHELF SUPPORT DEVICE AND COOKING APPLIANCE WITH THE SAME

(71) Applicant: LG Electronics Inc., Seoul (KR)

(72) Inventors: Kyoung-Joon Park, Seoul (KR); Hoon Seob Sim, Seoul (KR); Jaekyung Yang, Seoul (KR); Suyong Lee, Seoul (KR); Yongsoo Lee, Seoul (KR); Yong Hyun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 184 days.

(21) Appl. No.: 16/052,840

(22) Filed: Aug. 2, 2018

(65) Prior Publication Data

US 2019/0041065 A1 Feb. 7, 2019

(30) Foreign Application Priority Data

Aug. 3, 2017 (KR) ..... 10-2017-0098719

(51) Int. Cl.
*F24C 15/16* (2006.01)
*F25D 25/02* (2006.01)
(Continued)

(52) U.S. Cl.
CPC ..... *F24C 15/168* (2013.01); *A47B 77/10* (2013.01); *A47B 2088/901* (2017.01)

(58) Field of Classification Search
CPC ..... F24C 15/168; F24C 15/16; F25D 25/02; F25D 25/04; A47B 57/06
See application file for complete search history.

(56) References Cited

U.S. PATENT DOCUMENTS 3,316,044 A * 4/1967 Carbary ..... A47L 15/504 312/408
3,516,369 A * 6/1970 Bidak ..... F25D 25/02 108/138
(Continued)

FOREIGN PATENT DOCUMENTS

DE 10122834 A1 11/2002
GB 803331 A 10/1958
(Continued)

OTHER PUBLICATIONS

EP Search Report in European Application No. EP19186740, dated Nov. 21, 2019, 9 pages.
(Continued)

*Primary Examiner* — Kimberley S Wright
(74) *Attorney, Agent, or Firm* — Fish & Richardson P.C.

(57) ABSTRACT

The present disclosure relates a shelf support device and a cooking appliance with the same. The shelf support device includes a rail extending in forward and backward directions to locate a front end portion over a rear end portion, including an upper surface portion and a lower surface portion; and a support unit at which a shelf is mounted at an upper portion of the support unit, coupled to the rail to be movable along the movement path formed by each of the upper surface portion and the lower surface portion, and configured to change a position of the shelf in an upward direction when being moved in the forward direction and the position of the shelf in a downward direction when being moved in the backward direction.

19 Claims, 10 Drawing Sheets

(51) Int. Cl.

| | |
|---|---|
| ***A47L 15/50*** | (2006.01) |
| *A47B 88/90* | (2017.01) |
| *A47B 77/10* | (2006.01) |

(56) References Cited

U.S. PATENT DOCUMENTS

| | | | | |
|---|---|---|---|---|
| 5,231,933 | A | 8/1993 | DiRosa | |
| 9,420,882 | B2 * | 8/2016 | Garcia | A47B 46/005 |
| 9,510,676 | B2 | 12/2016 | Tarcy | |
| 2009/0085452 | A1 | 4/2009 | Rehage | |
| 2014/0132147 | A1 | 5/2014 | Tarcy | |
| 2015/0305493 | A1 * | 10/2015 | Garcia | A47B 46/005 211/86.01 |
| 2016/0262540 | A1 | 9/2016 | Chen et al. | |
| 2017/0164733 | A1 * | 6/2017 | Azkue | A47B 46/005 |

FOREIGN PATENT DOCUMENTS

| | | | |
|---|---|---|---|
| JP | 2004301356 | | 10/2004 |
| JP | 2010194252 | | 9/2010 |
| JP | 2010201063 | * | 9/2010 |
| JP | 5322814 | | 10/2013 |
| KR | 101688229 B1 | | 12/2016 |
| KR | 101735827 B1 | | 5/2017 |

OTHER PUBLICATIONS

EP Search Report in European Application No. EP19186742, dated Nov. 21, 2019, 8 pages.
Partial European Search Report in European Application No. 18186276.4, dated Nov. 20, 2018, 14 pages.

* cited by examiner

SHELF SUPPORT DEVICE AND COOKING APPLIANCE WITH THE SAME

CROSS-REFERENCE TO RELATED APPLICATIONS

This application claims the priority of Korean Patent Application No. 10-2017-0098719, filed on Aug. 3, 2017, in the Korean Intellectual Property Office, the disclosure of which is hereby incorporated by reference in its entirety.

BACKGROUND

1. Technical Field

The present disclosure relates to a shelf support device and a cooking appliance with the same, and more particularly, to a shelf support device capable of supporting a shelf or a rack so as to be withdrawn, which is configured to seat food on a cooking chamber of an oven and the like, and a cooking appliance with the same.

2. Description of the Related Art

A cooking appliance is one of home appliances for cooking food, and is a device that is installed in a kitchen space to cook the food according to an intent of a user. The cooking appliance may be variously classified into various categories according to a heat source, a form thereof, or a type of fuel, which is used in the cooking appliance.

When classifying the cooking appliance according to a type of cooking food, the cooking appliance may be classified into an open cooking apparatus and an enclosed cooking apparatus according to a shape of a space in which food is placed. The enclosed cooking appliance includes an oven, a microwave oven, and the like, and the open cooking appliance includes a hop top, and the like.

The enclosed cooking apparatus is a cooking apparatus configured to enclose a space in which food is placed and heat the enclosed space to cook the food. The enclosed cooking appliance is provided with a cooking chamber at which food is placed and which is a space that is enclosed when cooking the food. The cooking chamber is a space for actually cooking the food. A heat source is provided inside the cooking chamber or in an external space to heat the cooking chamber.

A shelf or a rack (hereinafter, collectively referred to as a "shelf") configured to seat food may be provided inside the cooking chamber. Also, for convenience of a user, the shelf may be provided so as to be withdrawn to a front side of the cooking chamber.

To allow the shelf to be withdrawn to the front side of the cooking chamber, a pair of guide members are provided on both side surfaces of the cooking chamber.

Each of the pair of guide members may be configured to include a guide rail formed to have a length extending a forward and backward directions and installed at both of the side surfaces of the cooking chamber, and a sliding rail installed at the guide rail and configured to be slidable along a length direction of the guide rail.

The shelf may be mounted on the sliding rail to move in forward and backward directions along the sliding rail, and thus front and rear positions of the shelf may be changed. Further, the mounting of the shelf may be such that the shelf is seated on an upper portion of the sliding rail in a state in which positions of the sliding rails provided at both sides of the shelf are aligned with each other in the forward and backward directions.

The shelf installed as described above is withdrawn in a form in which the user directly pulls the shelf from an inside of the cooking chamber or pushes the shelf into the cooking chamber. Conventionally, in a cooking appliance such as an oven, since a cooking chamber is located at a lower level than a waist of the user, an operation of placing food on the shelf or taking out the food placed on the shelf is inevitably performed in a state in which the user's waist is bent.

However, when the user places the food on the shelf and takes out the food placed on the shelf in a state in which the user's waist is bent, the user's waist is adversely affected as well as the center of gravity of the user moves forward, that is, toward a hot cooking chamber such that the risk of a safety accident is increased.

SUMMARY

It is an object of the present disclosure to provide a shelf support device with an improved structure capable of improving convenience of use and safety, and a cooking appliance with the same.

Objects of the present disclosure are not limited to the above-described objects and other objects and advantages can be appreciated by those skilled in the art from the following descriptions. Further, it will be easily appreciated that the objects and advantages of the present disclosure can be practiced by means recited in the appended claims and a combination thereof.

In accordance with one aspect of the present disclosure, a shelf support device includes a rail extending in forward and backward directions to locate a front end portion over a rear end portion, including an upper surface portion configured to form an upward sloping movement path toward a front side and a lower surface portion configured to form an upward sloping movement path toward the front side below the upper surface portion; and a support unit at which a shelf is mounted at an upper portion of the support unit, coupled to the rail to be movable along the movement path formed by each of the upper surface portion and the lower surface portion, and configured to change a position of the shelf in an upward direction when being moved in the forward direction and the position of the shelf in a downward direction when being moved in the backward direction.

Also, the support unit may include a first wheel disposed over the rail and provided to roll along the movement path formed by the upper surface portion; a second wheel disposed below the first wheel by interposing the rail and provided to roll along the movement path formed by the lower surface portion; and moving members at which the first wheel and the second wheel are installed and configured to be moved in synchronization with movements of the first wheel and the second wheel.

Also, the rail may further include a side wall portion formed to vertically protrude from a side portion of each of the upper surface portion and the lower surface portion, and configured to restrict a lateral direction movement of each of the first wheel and the second wheel which are engaged with the rail, and the rail is formed such that the upper surface portion, the lower surface portion, and the side wall portion are connected to form a "ㅓ" shape when viewed from the front side.

Also, the support unit may further include an elastic support member configured to elastically support at least one of the first wheel and the second wheel to tightly contact the first wheel and the second wheel to the rail, and the elastic support member provides an elastic force for pressurizing at least one of the first wheel and the second wheel to narrow a gap between the first wheel and the second wheel.

Also, the elastic support member may include a plate spring having one side in a length direction is coupled to the moving members, provided to be vertically elastically deformable centering on the one side in the length direction coupled to the moving members, and having the other side at which the second wheel is installed.

Also, the rail includes a thickness variation section in which a distance between the upper surface portion and the lower surface portion is gradually increased toward the rear end portion of the rail.

Also, the shelf support device may further include a fixing plate 110 at which the rail 120 is installed.

Also, a plurality of rails are disposed at the fixing plate and are spaced away from each other by a predetermined interval in the forward and backward direction, each of the first wheel and the second wheel is provided at the support unit with a number corresponding to the number of rails installed at the fixing plate, and the first wheel and the second wheel are respectively rollably coupled to each of the rails.

Also, the shelf support device may further include a movement blocking part configured to block a movement of the support unit at a set position.

Also, the movement blocking part may include a stopper provided to protrude from one side of the support unit, which faces the fixing plate; a first blocking protrusion provided to protrude from one side of the fixing plate, which faces the support unit, and configured to block a backward movement of the support unit located at a first position by being interfered with the stopper; and a second blocking protrusion provided to protrude from the one side of the fixing plate, which faces the support unit to be disposed in front of the first blocking protrusion, and configured to block a forward movement of the support unit located at a second position in front of the first position by being interfered with the stopper.

Also, the moving members may include a wheel frame at which the first wheel and the second wheel are installed, and configured to be moved in synchronization with movements of the first wheel and the second wheel; a guide rail part formed to have a length extending in the forward and backward directions and coupled to a wheel plate; and a gliding supporter on which the shelf is mounted over the gliding supporter and installed to be slidable in a length direction of the guide rail part.

Also, in accordance with one aspect of the present disclosure, a cooking appliance includes a main body at which a cooking chamber is formed, a shelf provided to be installed at the cooking chamber, and a shelf support device provided at the cooking chamber and configured to support the shelf, wherein the shelf support device includes a rail including extending in forward and backward directions to locate a front end portion over a rear end portion, an upper surface portion configured to form an upward sloping movement path toward a front side and a lower surface portion configured to form an upward sloping movement path toward the front side below the upper surface portion; and a support unit at which a shelf is mounted at an upper portion of the support unit, coupled to the rail to be movable along the movement path formed by each of the upper surface portion and the lower surface portion, and configured to change a position of the shelf in an upward direction when being moved in the forward direction and the position of the shelf in a downward direction when being moved in the backward direction.

Also, the shelf support device may further include a fixing plate that is installed at the rail, the support unit is coupled to the rail installed at the fixing plate to configure a support assembly, and a pair of the support assemblies are installed at both sides of the cooking chamber to face to each other.

Also, the support unit may include a first wheel disposed over the rail and provided to roll along the movement path formed by the upper surface portion; a second wheel disposed below the first wheel by interposing the rail and provided to roll along the movement path formed by the lower surface portion; and moving members at which the first wheel and the second wheel and configured to be moved in synchronization with movements of the first wheel and the second wheel.

Also, the moving members may include a wheel frame at which the first wheel and the second wheel are installed, and configured to be moved in synchronization with movements of the first wheel and the second wheel;

A guide rail part formed to have a length extending in the forward and backward directions and coupled to a wheel plate; and A gliding supporter on which the shelf is mounted over the gliding supporter and installed to be slidable in a length direction of the guide rail part.

In accordance with the shelf support device and the cooking appliance with the same according to the present disclosure, the user can place the food on the shelf or take out the food placed on the shelf without excessively bending the waist so that there is an advantage capable of providing an improved convenience of use and stability by reducing an adverse effect on the user's waist or the risk that the center of gravity of the user is shifted toward the hot cooking chamber side to cause a safety accident.

Also, in accordance with the shelf support device and the cooking appliance with the same according to the present disclosure, insertion of the shelf is performed at a gentle speed and thus impact, which may be generated in the insertion of the shelf, can be effectively alleviated such that it is possible to provide an effect of preventing generation of a large noise due to the impact generated in the insertion of the shelf, and occurrence of an accident that the food placed on the shelf escapes from the shelf.

DETAILED DESCRIPTION

Figure 1:
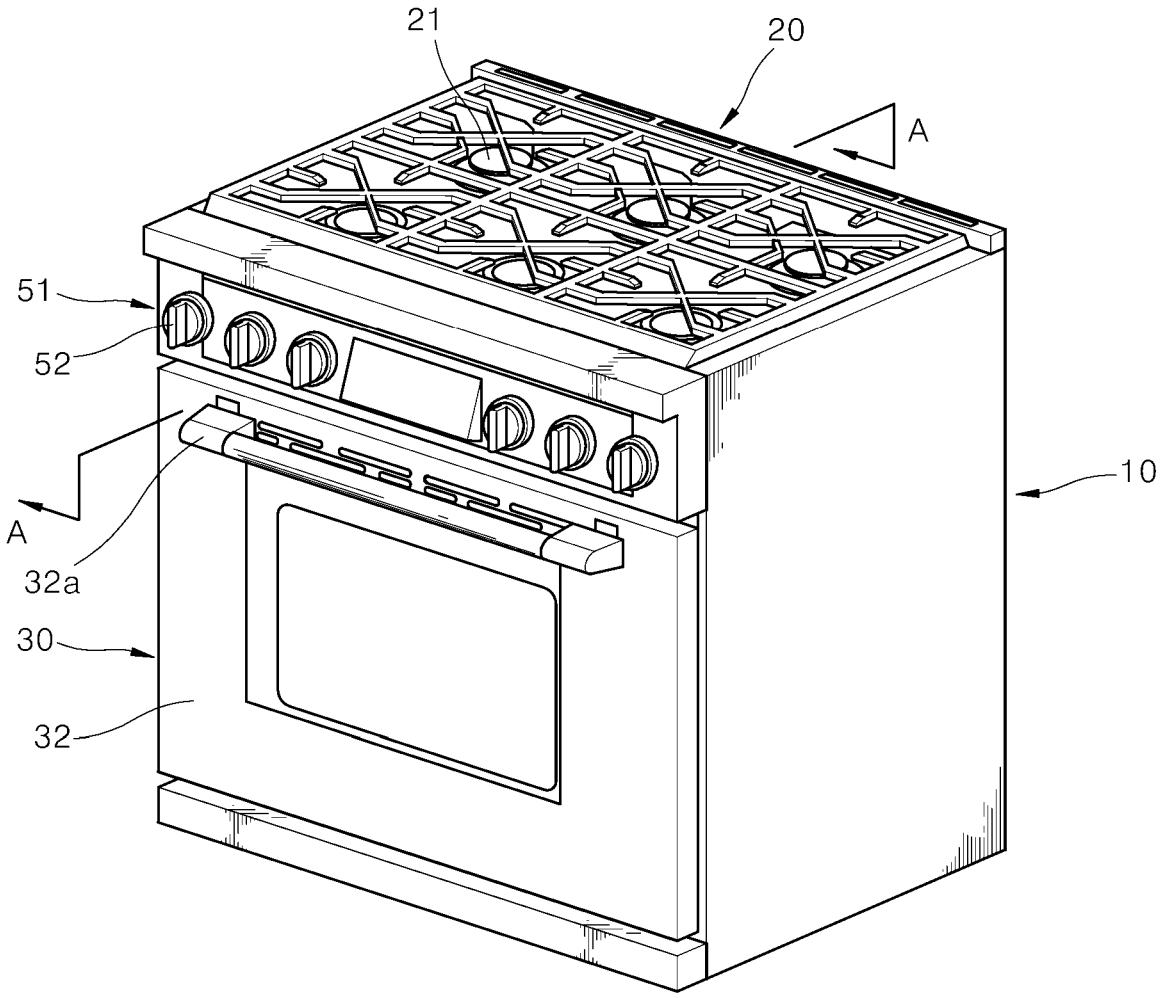
FIG. 1 is a perspective view schematically illustrating a cooking appliance according to one embodiment of the present disclosure.

Hereinafter, embodiments of a shelf support device and a cooking appliance with the same according to the present disclosure will be described with reference to the accompanying drawings. For convenience of description, thicknesses of lines and sizes of components shown in the drawings may be exaggerated for clarity and convenience of explanation. In addition, the terms described below are defined in consideration of the functions of the present disclosure, and these terms may vary depending on the intent or custom of the user or the operator. Therefore, these terms should be defined on the basis of the contents throughout the present application.

[Overall Structure of Cooking Appliance]

Figure 2:
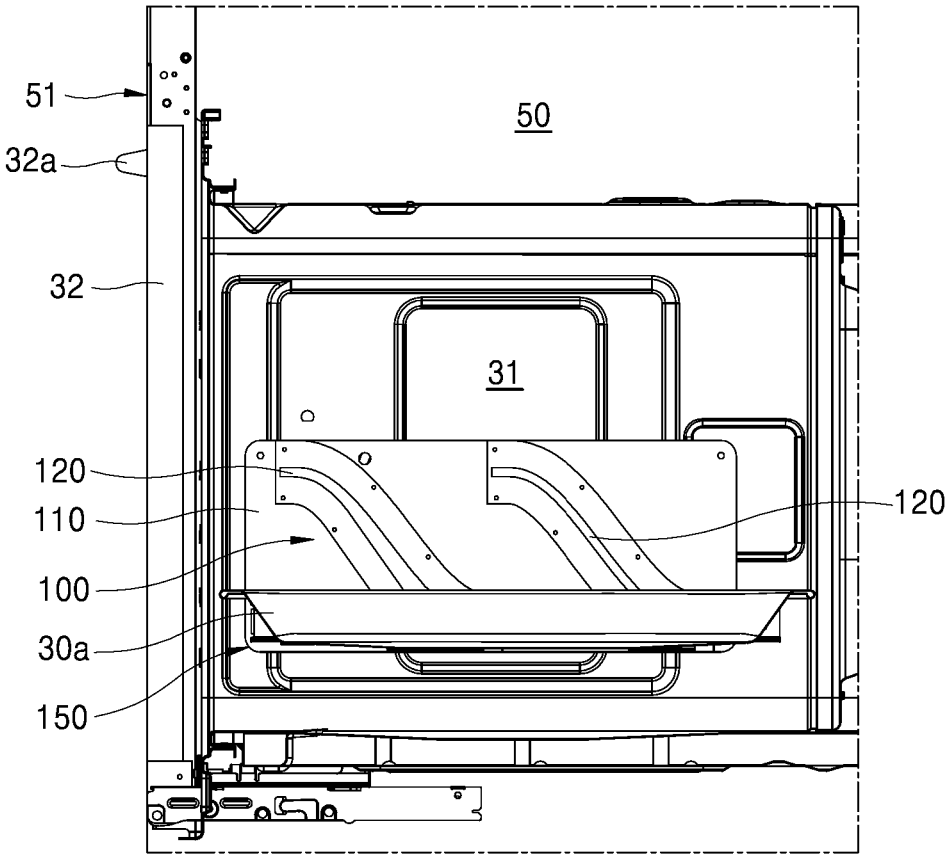
FIG. 2 is a side cross-sectional view taken along line A-A of FIG. 1.
Figure 3:
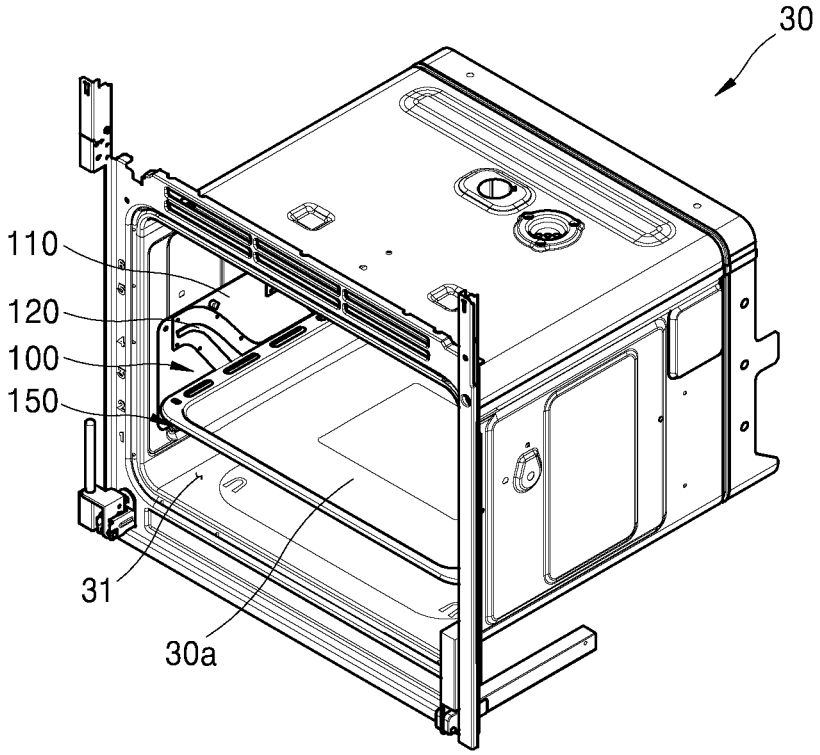
FIG. 3 is a perspective view illustrating an oven that is separated from the cooking appliance illustrated in FIG. 1.

FIG. 1 is a perspective view schematically illustrating a cooking appliance according to one embodiment of the present disclosure, FIG. 2 is a side cross-sectional view taken along line A-A of FIG. 1, and FIG. 3 is a perspective view illustrating an oven that is separated from the cooking appliance illustrated in FIG. 1.

Referring to FIGS. 1 to 2, an exterior appearance of the cooking appliance according to one embodiment of the present disclosure is formed by a main body 10. The main body 10 may be provided in a shape including an approximate rectangular parallelepiped shape, and is formed of a material having predetermined strength so as to protect a plurality of components installed in an internal space of the main body 10.

A cooktop 20, which is provided to heat an open space, that is, food or a vessel accommodating the food, which is placed over the cooktop 20, and cook the food.

At least one cooktop heating part 21 is located at the cooktop 20 to heat food to be cooked or a vessel accommodating the food.

Further, an oven 30 is installed below the cooktop 20. A cooking chamber 31 configured to provide a space in which food is cooked is located in an internal space of the oven 30.

The cooking chamber 31 is configured in a hexahedral shape having an open front surface, and, in a state in which the cooking chamber 31 is enclosed, an internal space of the cooking chamber 31 is heated to cook food. That is, in the oven 30, the internal space of the cooking chamber 31 is a space in which the food is substantially cooked.

A door 32 configured to selectively open and close the cooking chamber 31 is pivotably provided at the oven 30. The door 32 may open and close the cooking chamber 31 in a pull-down manner in which an upper end of the door 32 is vertically pivoted centering on a lower end of the door 32.

The door 32 is configured in a hexahedral shape entirely having a predetermined thickness, and a handle 32*a* configured to allow a user to grip the door 32 when the user wishes to pivot the door 32 is installed at a front surface of the door 32. The user may easily pivot the door 32 through the handle 32*a*.

A control panel 51 is provided at a front surface of the cooktop 20, that is, over the door 32. The control panel 51 may be configured in a hexahedral shape having a predetermined internal space, and an input part 52 configured to input a manipulation signal by which the user operates the cooktop 20 and the oven 30 is provided on a front surface of the control panel 51.

A plurality of manipulation switches are provided at the input part 52, and, through such manipulation switches, the user may directly input the manipulation signal.

Also, a display may be further provided at the control panel 51 to provide operation information of the cooking appliance, cooking information of food, or the like, and the user may verify various information regarding the shelf support device and the cooking appliance with the same through the display.

An electronic chamber 50 configured to provide a space in which electric and electronic components are located is formed in the internal space of the main body 10, that is, a space between the cooktop 20 and the oven 30. The control panel 51 is located at the front surface of the electronic chamber 50, and thus a structure is configured such that the control panel 51 substantially blocks the front surface of the electronic chamber 50.

Meanwhile, a shelf 30*a* or a rack configured to seat food may be provided inside the cooking chamber 31. In the present embodiment, a case in which the shelf 30*a* is provided inside the cooking chamber 31 is exemplified and described.

The shelf 30*a* may be detachably installed inside the cooking chamber 31, and, for convenience of the user, the shelf 30*a* may be provided to be vertically displaceable and to be withdrawable to a front side of the cooking chamber 31.

To provide the shelf 30*a* to be vertically displaceable and to be withdrawable to the front side of the cooking chamber 31, a shelf support device 100 configured to support the shelf 30*a* is provided inside the cooking chamber 31.

[Overall Structure of Shelf Support Device]

Figure 4:
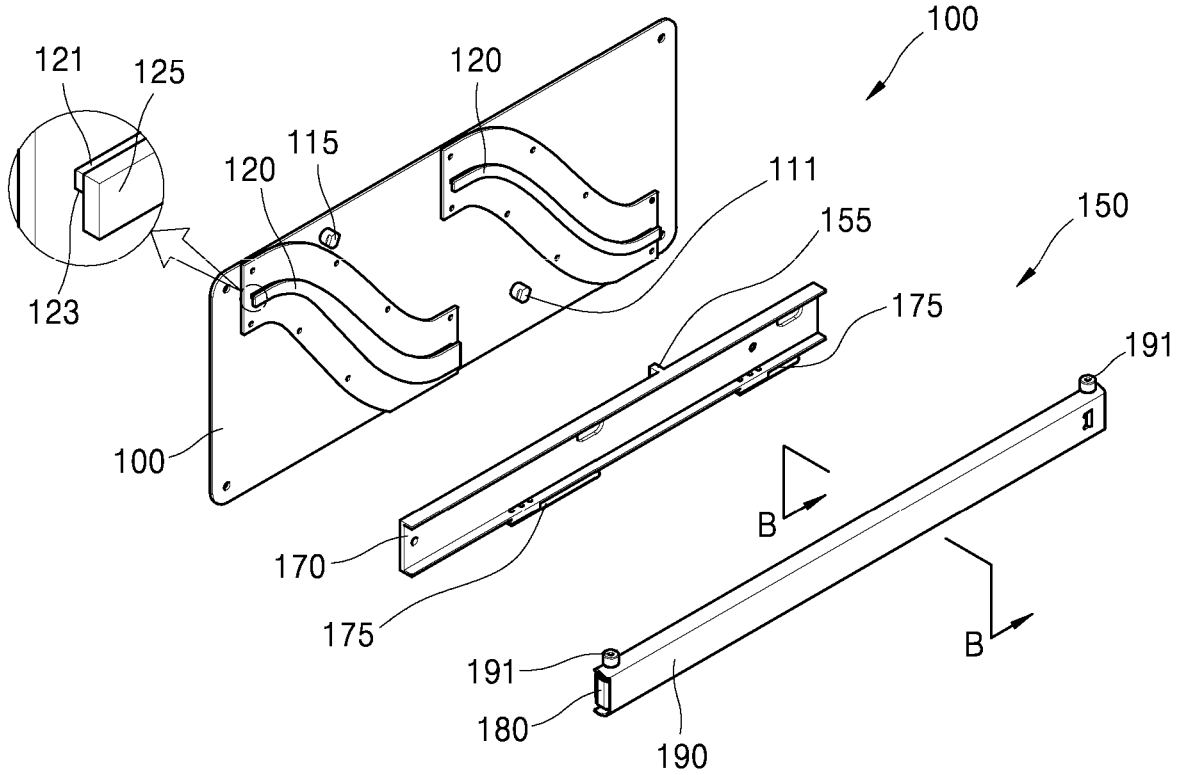
FIG. 4 is an exploded perspective view illustrating decomposed components of a shelf support device illustrated in FIG. 3.

FIG. 4 is an exploded perspective view illustrating decomposed components of a shelf support device illustrated in FIG. 3.

Referring to FIGS. 2 to 4, the shelf support device 100 according to one embodiment of the present disclosure is configured to include a pair of support assemblies installed inside the cooking chamber 31. In the present embodiment, a case, in which one support assembly is installed at a left side surface inside the cooking chamber 31 and the other support assembly is installed at a right side surface thereinside so that the pair of support assemblies are installed to face each other inside the cooking chamber 31, is exemplified.

Each of the support assemblies installed as described above may be configured to include a fixing plate 110, a rail 120, and a support unit 150.

The fixing plate 110 is provided to fix the support assembly, particularly, the rail 120 inside the cooking chamber 31, and is provided in a form of a flat plate of a metal material, which has an area capable of accommodating the rails 120.

The fixing plate 110, which is provided as described above, is coupled to the left side surface or the right side surface inside the cooking chamber 31 and installed inside the cooking chamber 31, and a pair of the rails 120 are coupled to the fixing plate 110. In the present embodiment, a case, in which the fixing plate 110 is installed at each of the left side surface and the right side surface inside the cooking chamber 31, is exemplified.

The rail 120 is installed inside the cooking chamber 31 to form a movement path of the support unit 150. As an example, the rail 120 may be coupled to the fixing plate 110 and, through the coupling to the fixing plate 110, the rail 120 may be installed at the left side surface or the right side surface inside the cooking chamber 31.

As another example, the rail 120 may be installed inside the cooking chamber 31 in a form of being directly coupled to the left side surface or the right side surface inside the cooking chamber 31 without the fixing plate 110.

According to the present embodiment, a plurality of rails 120 are installed at the left side surface inside the cooking chamber 31, and a plurality of rails 120 are also installed at the right side surface inside the cooking chamber 31. At this point, the rails 120 installed at each the side surfaces inside the cooking chamber 31 are disposed in forward and backward directions of the cooking chamber 31. That is, a plurality of rails 120 are disposed at each of the side surfaces inside the cooking chamber 31 in the forward and backward directions thereof, and the plurality of rails 120 are spaced apart from each other at predetermined intervals in the forward and backward directions.

Accordingly, when the plurality of rails 120 are installed at each of the side surfaces inside the cooking chamber 31, supporting of the support unit 150, which is installed to move along a movement path formed by the plurality of rails 120, may be performed at a plurality of points, so that the support unit 150 may move while a posture of the support unit 150 is stably maintained not to lean to one direction.

In the present embodiment, a case, in which a pair of rails 120 are installed at each of the side surfaces inside the cooking chamber 31, is exemplified.

Each of the rails 120 is formed to extend in the forward and backward directions to locate a front end portion above a rear end portion. An upper surface portion 121 is formed at an upper portion of each of the rails 120, and a lower surface portion 123 is formed at a lower portion of each of the rails 120.

The upper surface portion 121 forms an upper surface of each of the rails 120, and a movement path upwardly forwardly sloping over each of the rails 120. Further, the lower surface portion 123 forms a lower surface of each of the rails 120, and a movement path upwardly forwardly sloping at a lower side of each of the rails 120, that is, below the upper surface portion 121.

The support unit 150 is installed inside the cooking chamber 31 to move along the movement path formed by each of the rails 120. According to the present embodiment, the support unit 150 is installed at each of the side surfaces inside the cooking chamber 31, and the support unit 150 is movably coupled to each of the rails 120 installed at each of the side surfaces inside the cooking chamber 31. Accordingly, the support unit 150 coupled to each of the rails 120 may be installed to be movable in the forward and backward directions along the movement path formed by the upper surface portion 121 and the lower surface portion 123 of each of the rails 120.

As described above, the shelf 30*a*, which is a support target of the support unit 150, may be mounted over a pair of support units 150 installed inside the cooking chamber 31. In a state in which the shelf 30*a* is mounted over the pair of support units 150, the pair of support units 150 may move in the forward and backward directions along the movement path formed by each of the rails 120, and the shelf 30*a* may be withdrawn from the cooking chamber 31 or may be inserted thereinto by the pair of support units 150 which move as described above.

According to the present embodiment, when the shelf 30*a* is withdrawn from the cooking chamber 31, a position of the shelf 30*a* may be changed in forward and upward directions, and, when the shelf 30*a* is inserted into the cooking chamber 31, the position of the shelf 30*a* may be changed in backward and downward directions. A detailed description thereof will be described below.

[Structure of Support Unit]

Figure 5:
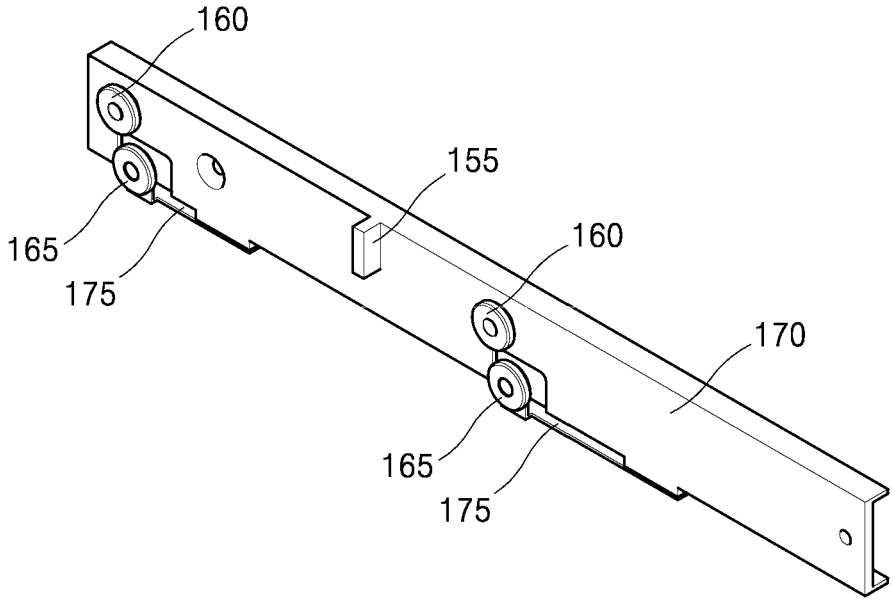
FIG. 5 is a diagram illustrating one side of a moving member illustrated in FIG. 4.
Figure 6:
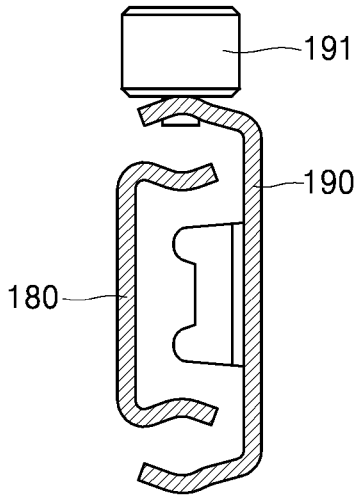
FIG. 6 is a cross-sectional view taken along line B-B of FIG. 4.
Figure 7:
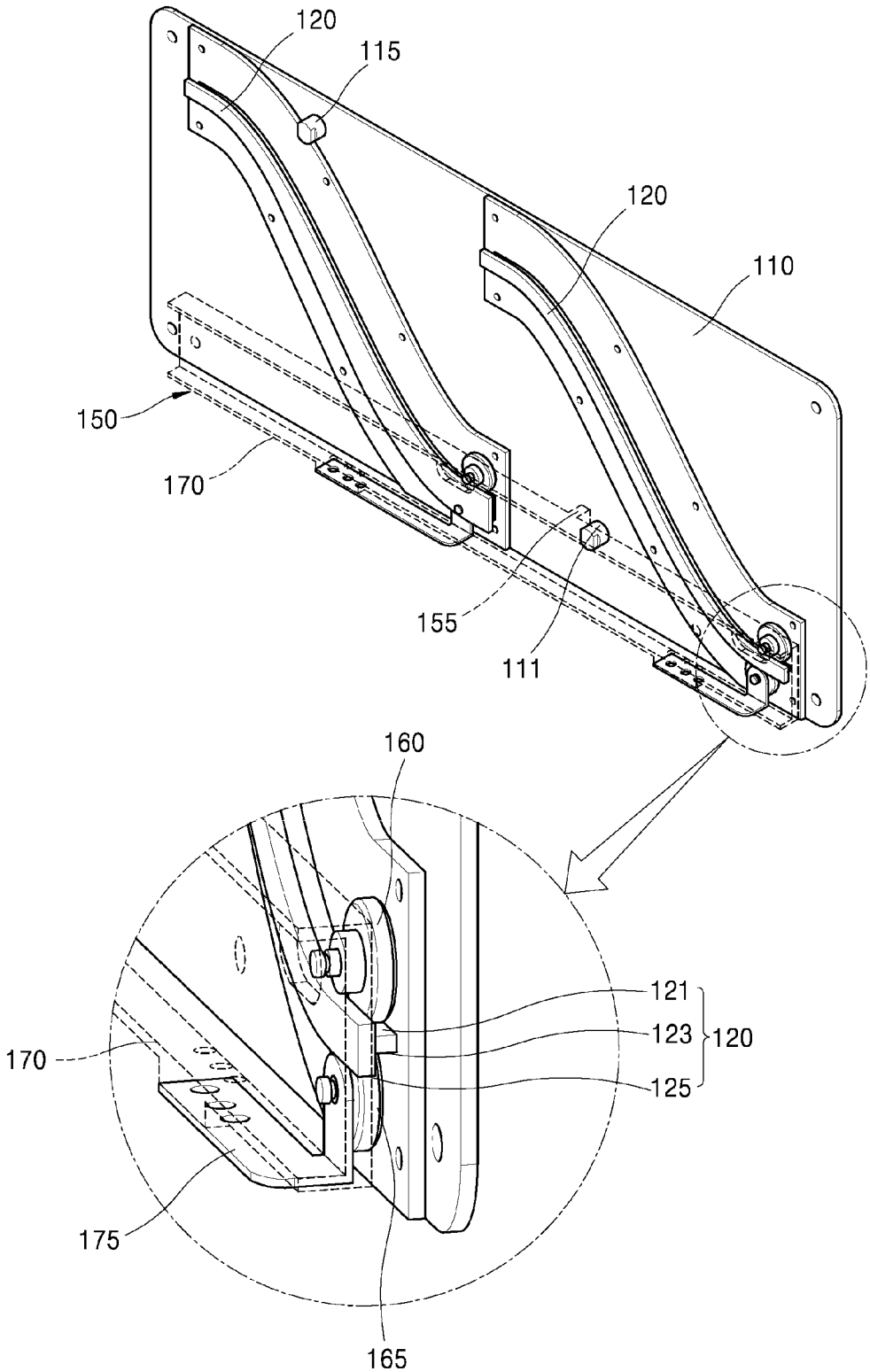
FIG. 7 is a diagram illustrating an engagement state between a rail and a support unit which are illustrated in FIG. 4.

FIG. 5 is a diagram illustrating one side of a moving member illustrated in FIG. 4, FIG. 6 is a cross-sectional view taken along line B-B of FIG. 4, and FIG. 7 is a diagram illustrating an engagement state between a rail and a support unit which are illustrated in FIG. 4.

Referring to FIGS. 3 to 5, the support unit 150 may be configured to include a first wheel 160, a second wheel 165, and moving members 170, 180, and 190.

The first wheel 160 is rotatably installed at each of the moving members 170, 180, and 190. The first wheel 160 is disposed at the upper portion of each of the rails 120, and is provided to roll along the movement path formed by the upper surface portion 121.

The second wheel 165 is disposed below the first wheel 160 and is rotatably installed at each of the moving members 170, 180, and 190. The second wheel 165 is disposed below each of the rails 120 and is provided to roll along the movement path formed by the lower surface portion 123. At this point, the first wheel 160 and the second wheel 165 are installed at one of the moving members 170, 180, and 190, to move together with the moving members 170, 180, and 190. That is, movements of the first wheel 160, the second wheel 165, and the moving members 170, 180, and 190 are integrally performed instead of being separately performed.

The first wheel 160 and the second wheel 165 are provided with a number corresponding to the number of the rails 120 installed at each of the fixing plates 110, that is, the number of the rails 120 installed at each of the side surfaces of the cooking chamber 31. In the present embodiment, a case, in which a pair of rails 120 are disposed at each of the fixing plates 110 and spaced apart from each other by a predetermined distance in the forward and backward directions, and a pair of the first wheel 160 and the second wheel 165 are installed at the support unit 150 at an interval corresponding to the spaced distance between the pair of rails 120, is exemplified.

Each of the first wheel 160 and the second wheel 165 is rollingly coupled to each of the pair of rails 120. That is, the first wheel 160 and the second wheel 165 are rollingly coupled to a rail 120 disposed at a front side and a rail 120 disposed at a rear side. The first wheel 160 and the second wheel 165 coupled to each of the rails 120 may move along the movement path formed on each of the rails 120.

Accordingly, one group of a first wheel 160 and a second wheel 165, which is located at the front side, and another group of a first wheel 160 and a second wheel 165, which is located at the rear side, are integrally moved together with the moving members 170, 180, and 190. That is, when the support unit 150 is moved, all the first wheels 160 and the second wheels 165 of the two groups and the moving members 170, 180, and 190 are integrally moved.

Consequently, the moving members 170, 180, 190 are supported by one group of the first wheel 160 and the second wheel 165, which is located at the front side, in the forward direction of the moving members 170, 180, and 190, and by another group of the first wheel 160 and the second wheel 165, which is located at the rear side, in the backward direction thereof, so that the moving members 170, 180, and 190 may be moved in the forward and backward directions.

The moving members 170, 180 and 190 may be moved in a state in which the moving members 170, 180 and 190 are supported by at least two points, and thus the support unit 150 may be moved while a posture of each of the moving members 170, 180 and 190 is stably maintained without leaning to one direction when the moving members 170, 180 and 190 are moved.

As is described above, the two groups of the first wheels 160 and the second wheels 165 are installed at the moving members 170, 180, and 190, and the moving members 170, 180, and 190 are coupled to each of the rails 120 via a coupling between the first wheel 160, the second wheel 165, and the rail 120. Such moving members 170, 180, and 190 may be moved in the forward and backward directions in association with the movement of the first wheel 160 and the second wheel 165 while upwardly supporting the shelf 30*a* mounted over the moving members 170, 180, and 190.

According to the present embodiment, the moving members 170, 180, and 190 may configured to include a wheel frame 170, a guide rail frame 180, and a gliding supporter 190.

The wheel frame 170 is provided in a form of a frame having a length extending in the forward and backward directions. The two groups of the first wheels 160 and the second wheels 165 are provided at one side of the wheel frame 170, which faces each of the rails 120, and the two groups are installed and spaced apart from each other by a predetermined interval in a length direction of the wheel frame 170, more specifically, spaced apart from each other by an interval corresponding to the spaced distance between two rails 120.

Referring to FIGS. 3 to 6, a guide rail frame 180 is coupled to the other side of the wheel frame 170, which is opposite to the side at which the first wheel 160 and the second wheel 165 are installed. The guide rail frame 180 has a length extending in the forward and backward directions and is provided in a shape including a cross section of a "[" shape. This guide rail frame 180 may be coupled to the wheel frame 170 and may be moved with the wheel frame 170.

Like the guide rail frame 180, the gliding supporter 190 has a length extending in the forward and backward directions and is provided in a shape including a cross section of a "]" shape that is able to be engaged with the guide rail frame 180.

The gliding supporter 190 is installed to be slidable in a length direction of the guide rail frame 180, and forward and backward lengths of the moving members 170, 180, and 190 may be varied by forward and backward sliding movements of the gliding supporter 190 in the length direction of the guide rail frame 180.

In addition, the gliding supporter 190 may be provided with a mounting protrusion 191 configured to couple the support unit 150 to the shelf 30*a* mounted over the support unit 150.

The mounting protrusion 191 is provided to protrude from an upper surface of the gliding supporter 190, and the coupling between the support unit 150 and the shelf 30*a* may be achieved by fitting the mounting protrusion 191 into a mounting hole formed at an edge of the shelf 30*a*.

Meanwhile, the support unit 150 of the present embodiment may further include an elastic support member 175.

The elastic support member 175 serves to elastically support at least one of the first wheel 160 and the second wheel 165 so that the first wheel 160 and the second wheel 165 are in close contact with each of the rails 120. The elastic support member 175 is provided in a form of providing an elastic force for pressurizing at least one of the first wheel 160 and the second wheel 165 to narrow a gap between the first wheel 160 and the second wheel 165.

According to the present embodiment, the elastic support member 175 may be configured to include a plate spring. The plate spring provided at the support unit 150 as the elastic support member 175 is provided such that one side of the plate spring in a length direction thereof is coupled to the moving members 170, 180, and 190, and is provided to be vertically elastically deformable centering on the one side in the length direction, which is coupled to the moving members 170, 180, and 190. Further, the second wheel 165 is installed at the other side of the plate spring in the length direction thereof, that is, at a side opposite to the coupling portion between the plate spring and the moving members 170, 180, and 190.

According to the installation structure of the elastic support member 175 and the second wheel 165, the elastic support member 175 provides an elastic force to elastically support and upwardly pressurize the second wheel 165. That is, the elastic support member 175 provides the elastic force to pressurize the second wheel 165 in a direction in which a gap between the first wheel 160 and the second wheel 165 is narrowed so that the elastic support member 175 serves to increase adherency between the rail 120, which is located between the first and second wheels 160 and 165, and the first and second wheels 160 and 165, and at the same time to effectively adjust the gap between the first wheel 160 and the second wheel 165 in response to variation in thickness of the rail 120 when the support unit 150 is moved.

In addition, as shown in FIGS. 4 and 7, the support unit 150 of the present embodiment may further include a movement blocking part provided to prevent a movement of the support unit 150 at a predetermined position.

In the present embodiment, the movement blocking part is exemplified and configured to include a stopper 155, a first blocking protrusion 111, and a second blocking protrusion 115.

The stopper 155 is provided in a form of a protrusion protruding from one side of the support unit 150, which faces the fixing plate 110, more specifically, protruding from one side surface of the wheel frame 170, which faces the fixing plate 110. The stopper 155 is moved in the forward and backward directions in association with the support unit 150, and, when interfered with the first blocking protrusion 111 or the second blocking protrusion 115, the stopper 155 serves to restrict a further movement of the support unit 150 while the support unit 150 is being moved.

The first blocking protrusion 111 is provided to protrude from one side of the fixing plate 110, which faces the support unit 150. The first blocking protrusion 111 is interfered with the stopper 155, which is provided at the support unit 150 moved to a first position, to serve to prevent a further backward movement of the support unit 150 that is located at the first position.

Here, the first position is defined as a position of the support unit 150 moved to a position where the shelf 30*a* is completely inserted into the cooking chamber 31. Further, a vertical position of the shelf 30*a* at the first position is a lowest position within a range in which the shelf 30*a* may be positioned.

The second blocking protrusion 115 is provided to protrude from one side of the fixing plate 110, which faces the support unit 150, and is forwardly upwardly disposed than the first blocking protrusion 111. The first blocking protrusion 115 is interfered with the stopper 155, which is provided at the support unit 150 moved to a second position, to serve to prevent a further forward movement of the support unit 150 that is located at the second position.

Here, the second position is a position that is forwardly upwardly disposed than the first position, and is defined as a position of the support unit 150 that is moved to a position where the shelf 30*a* may be maintained in a state of being withdrawn out of the cooking chamber 31. Further, a vertical position of the shelf 30*a* at the second position is an uppermost position where the shelf 30*a* may be withdrawn out of the cooking chamber 31 within a range in which the support unit 150 may move.

[Structure of Rail]

Referring to FIGS. 2 and 7, the rail 120 may further include a side wall portion 125 in addition to the upper surface portion 121 and the lower surface portion 123. The side wall portion 125 is formed to vertically protrude from side portions of the upper surface portion 121 and the lower surface portion 123. The side wall portion 125 is formed at a side portion of the rail 120, wherein the side wall portion 125 is formed to protrude from a side portion facing the support unit 150. When viewed from the front side, the rail 120 including the side wall portion 125 is formed such that the upper surface portion 121, the lower surface portion 123, and the side wall portion 125 are formed to have a "⊣" shape and to be connected to each other.

By the side wall portion 125, a fitting groove of a "⊔" shape, in which the upper surface portion 121 configures a bottom surface and the fixing plate 110 and the side wall portion 125 configure both side walls, is formed on the upper portion of the rail 120, and a fitting groove of a "⊓" shape, in which the lower surface portion 123 configures an upper surface and the fixing plate 110 and the side wall portion 125 configure both side walls, is formed on the lower portion of the rail 120.

The first wheel 160 is fitted into the fitting groove of the "⊔" shape, which is formed on the upper portion of the rail 120, and the second wheel 165 is fitted into the fitting groove of the "⊓" shape, which is formed on the lower portion of the rail 120.

Owing to the coupling between the rail 120 and the first and second wheels 160 and 165 as is described above, the first wheel 160 and the second wheel 165 may stably move along the movement path formed on the rail 120 without escaping from the rail 120.

According to the present embodiment, each of the rails 120 is formed in an upward sloping form of a "/" shape to locate the front end of the rail 120 above the rear end thereof. Preferably, a slope of the rail 120 may be formed in a curved shape rather than a straight shape.

For example, each of the rails 120 may be formed in a shape corresponding to a graph shape satisfying the following Equation.

$$y = \frac{H}{2}\left(1 - \cos\frac{\pi x}{W}\right)$$

Here, H is a height of the cooking chamber 31, W is a length of the cooking chamber 31 in the forward and backward directions, and a range of x is $0 \le x \le W/2$.

Looking at a graph shape satisfying Equation, a rising curve having a gentle slope is formed at a section around x=0, that is, at a section where the graph begins, and a rising curve having a gentle slope is formed at a section where x=W/2, that is, even at an ending section of the graph.

According to the rail 120 formed in the above-described shape, there is an advantage in which a force required to move the shelf 30*a* (See, FIG. 3) is not abruptly varied, and thus the support unit 150 may be moved with a lesser force by the user at an initial movement and a final movement of the support unit 150 which supports the shelf 30*a*.

In consideration of the shape of the rail 120 formed as described above, the first wheel 160 and the second wheel 165 are provided such that the gap between the first wheel 160 and the second wheel 165 can be flexibly changed. The elastically varied gap structure between the first wheel 160 and the second wheel 165 may be implemented using a structure in which the second wheel 165 is elastically supported by the elastic support member 175.

The second wheel 165 elastically supported by the elastic support member 175 may roll to move on the rail 120 in a state of being in close contact with the rail 120 by the elastic force provided by the elastic support member 175, and the first wheel 160 may also roll to move on the rail 120 in a state of being in close contact with the rail 120 in association with the second wheel 165.

In addition, the elastically varied gap structure between the first wheel 160 and the second wheel 165 provided as described above allows the gap therebetween to be flexibly varied according to circumstances, so that the wheel 160 and the second wheel 165, which integrally move, may stably move the movement path on the rail 120, which is formed in a curved shape, while stably maintaining the state of being in close contact with the rail 120.

Figure 8:
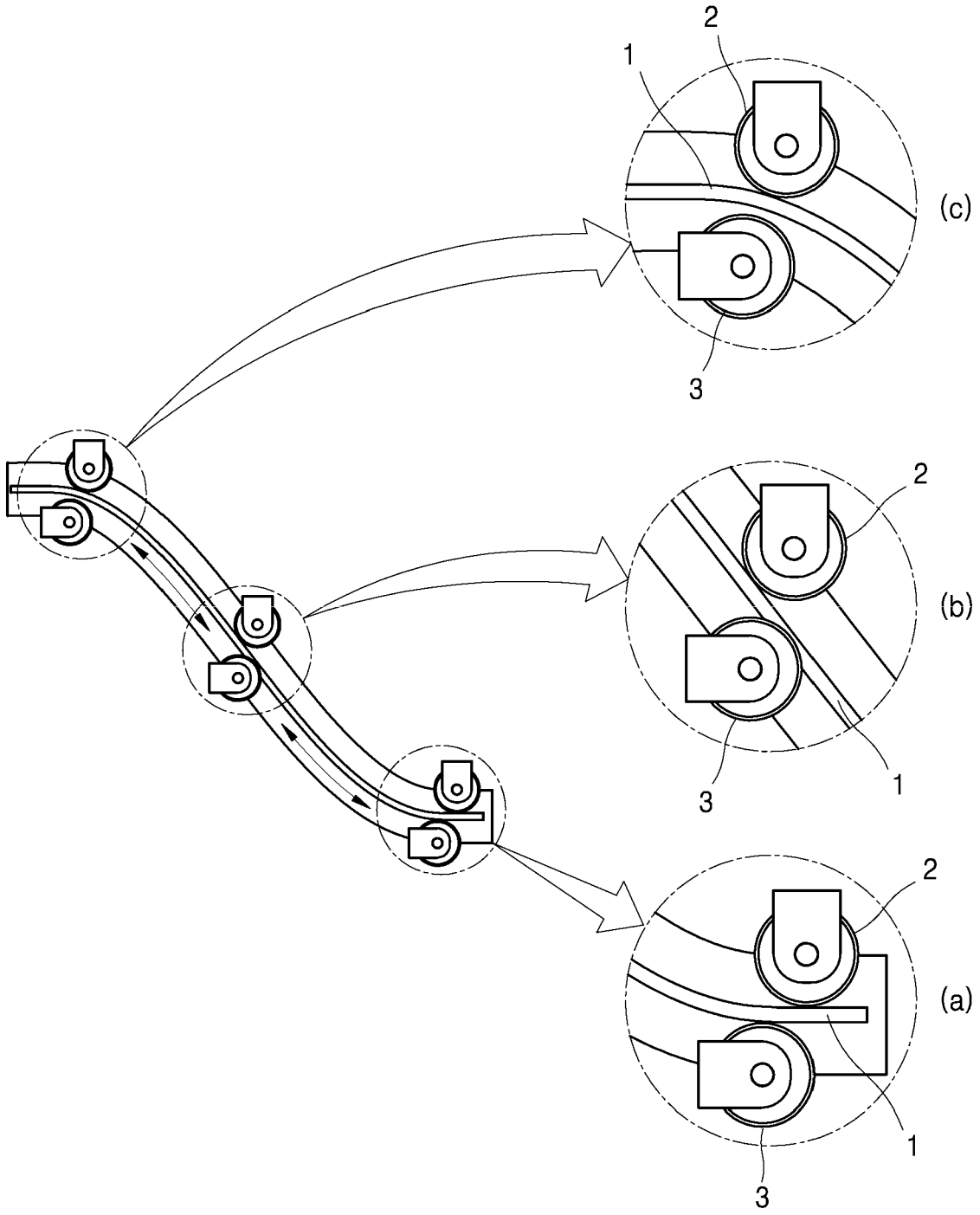
FIG. 8 is a diagram illustrating an engagement relationship between the rail and a wheel when the wheel is fixed.
Figure 9:
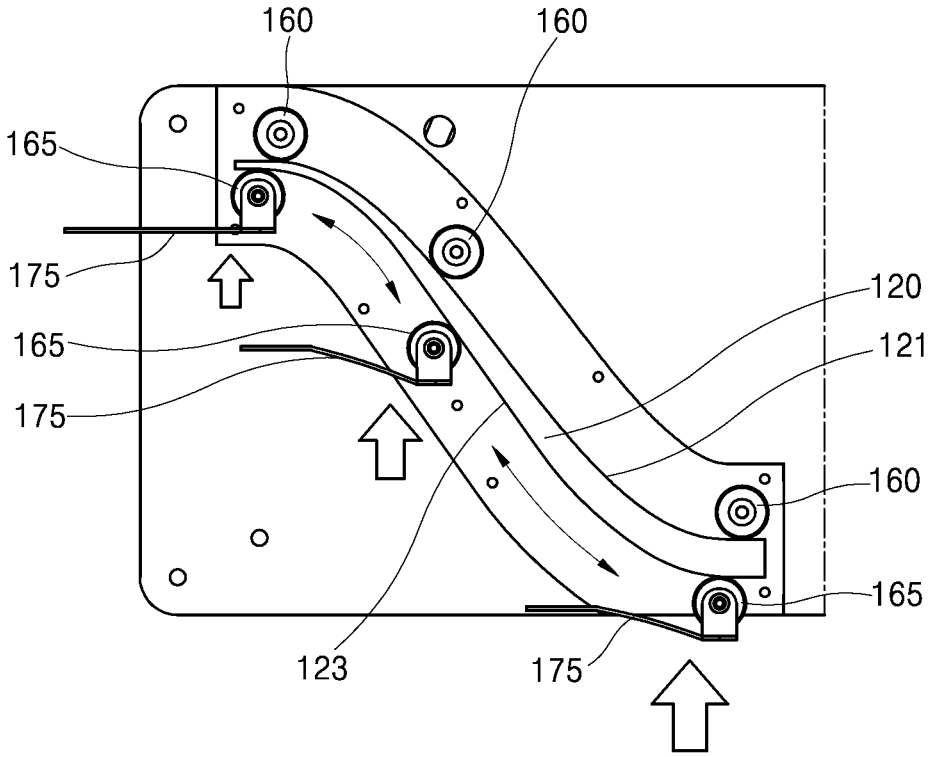
FIG. 9 is a diagram illustrating a variation state of an elastic force acting between the rail and the wheel.

FIG. 8 is a diagram illustrating an engagement relationship between the rail and the wheels when the wheels are fixed, and FIG. 9 is a diagram illustrating a variation state of an elastic force acting between the rail and the wheels.

FIG. 8 illustrates a structure in which a pair of wheels 2 and 3 are installed at a rail 1, which is formed in a curved shape, in a state in which a gap between the pair of wheels 2 and 3 is fixed not to be adjusted. At this point, the gap between the pair of wheels 2 and 3 is set to a gap corresponding to a thickness of the rail 1, and the rail 1 is provided in a form of extending with a constant thickness.

In this case, at a point (a) where the rail 1 extends in a direction close to a horizontal direction, a vertical direction between a point at which the upper-side wheel 2 is in contact with an upper surface of the rail 1 and a point at which the lower-side wheel 3 is in contact with a lower surface of the rail 1 is substantially equal to the gap between the pair of wheels 2 and 3, so that there is no problem in moving the wheels 2 and 3.

However, at point (b) at which the rail 1 obliquely extends, the vertical direction between the point at which the upper-side wheel 2 is in contact with the upper surface of the rail 1 and the point at which the lower-side wheel 3 is in contact with the lower surface of the rail 1 becomes longer than the gap between the pair of wheels 2 and 3. Therefore, at the point (b), it is difficult to move the wheels 2 and 3 due to interference generated between the rail 1 and the wheels 2 and 3.

At the point (c) where a slope of the rail 1 is lower than that of the point (b), the vertical direction between the point at which the upper-side wheel 2 is in contact with the upper surface of the rail 1 and the point at which the lower-side wheel 3 is in contact with the lower surface of the rail 1 becomes shorter than the gap between the pair of wheels 2 and 3. Therefore, at the point (c), due to the gap generated between the rail 1 and the wheels 2 and 3, the wheels 2 and 3 may not be in close contact with the rail 1 and thus a rattling phenomenon may occur.

In consideration of such circumstance, in the shelf support device of the present embodiment, as shown in FIGS. 7 and 9, the structure in which the gap between the first wheel 160 and the second wheel 165 may be elastically varied is employed, so that the first wheel 160 and the second wheel 165, which integrally move, may stably move along the movement path on the rail 120 formed in the curved shape while maintaining a state of being stably in close contact with the rail 120.

Meanwhile, the rail 120 of the present embodiment may include a thickness variation section. The thickness variation section is a section that is formed on the rail 120 to induce deceleration or acceleration of the support unit 150 being moved along the rail 120 and the shelf 30*a* mounted over the support unit 150, and the thickness variation section corresponds to a section in which a distance between the upper surface portion 121 and the lower surface portion 123 gradually increases toward the rear end portion of the rail 120, that is, a section in which the thickness of the rail 120 is increased toward the rear end portion of the rail 120.

In the present embodiment, the shape of the rail 120 is exemplified and determined such that a thickness of the front end portion of the rail 120 is a thinnest, the thickness of the rail 120 is gradually increased toward the rear side of the rail 120, and a thickness of the rear side portion of the rail 120 is a thickest. That is, in the present embodiment, a case, in which the rail 120 entirely corresponds to the thickness variation section, and the thickness of the front end portion of the rail 120 located at the uppermost position is the thinnest, and the thickness of the rail 120 gradually increases toward the lower portion of the rail 120, is exemplified.

When the rail 120 is formed as is described above, the support unit 150 being moved in the backward direction receives a resistance force against the movement of the support unit 150 due to the thickness of the rail 120, which becomes thicker toward the rear, and, as being moved to the backward direction, the support unit 150 receives a greater resistance force.

According to the present embodiment, the resistance force is provided by the elastic force that is generated at the elastic support member 175. That is, the elastic support member 175 provides an elastic force to pressurize the second wheel 165 in a direction in which the gap between the first wheel 160 and the second wheel 165 is narrowed, and, as shown in FIG. 9, as the thickness of the rail 120 becomes thicker such that the gap between the first wheel 160 and the second wheel 165 increases, a magnitude of the elastic force, which acts as described above, increases. Further, the elastic force increased as described above acts as a greater force to narrow the gap between the first wheel 160 and the second wheel 165, and thus a greater resistance force acts to the support unit 150.

Consequently, as the support unit 150 is moved to the backward direction, a greater resistance force is applied to the support unit 150, and thus deceleration of the support unit 150 is induced by the resistance force.

The movement path on which the support unit 150 is moved to the backward direction is a movement path that is inclined to lower a position of the support unit 150 toward the backward direction. Therefore, when the movement of the support unit 150 toward the backward direction is performed without deceleration, a considerable impact is inevitably applied to the support unit 150 and the shelf 30*a* at a position where the movement of the support unit 150 is terminated such that there occurs a phenomenon in which loud noise is generated or food placed on the shelf 30*a* escapes therefrom.

In consideration of such circumstance, the shelf support device of the present embodiment is provided with the rail 120 formed to have a thickness that becomes thinner toward the front side and the upper portion and becomes thicker toward the rear side and the lower portion, and employs a structure in which, as the support unit 150 installed at the rail 20 is moved to the backward direction, a greater resistance force for deceleration of the support unit 150 acts, thereby alleviating impact which may be caused by a weight of the support unit 150 when the support unit 150 is moved in the backward direction.

In the present embodiment, a case, in which a single rail 120, which is located at the front side, of the pair of the rails 120 is formed in a such a shape, that is, the thickness of the rail 120 becomes thinner toward the front side and the upper portion, and becomes thicker toward the rear side and the lower portion, is exemplified.

As another example, the rail 120, which is located at the front side, of the pair of the rails 120 may be formed to have a thickness which becomes thinner toward the front side and the upper portion, and becomes thicker toward the rear side and the lower portion.

As still another example, both the pair of the rails 120 may be formed to have a thickness which becomes thinner toward the front side and the upper portion, and becomes thicker toward the rear side and the lower portion.

[Operation and Effect of Shelf Support Device]

Figure 10:
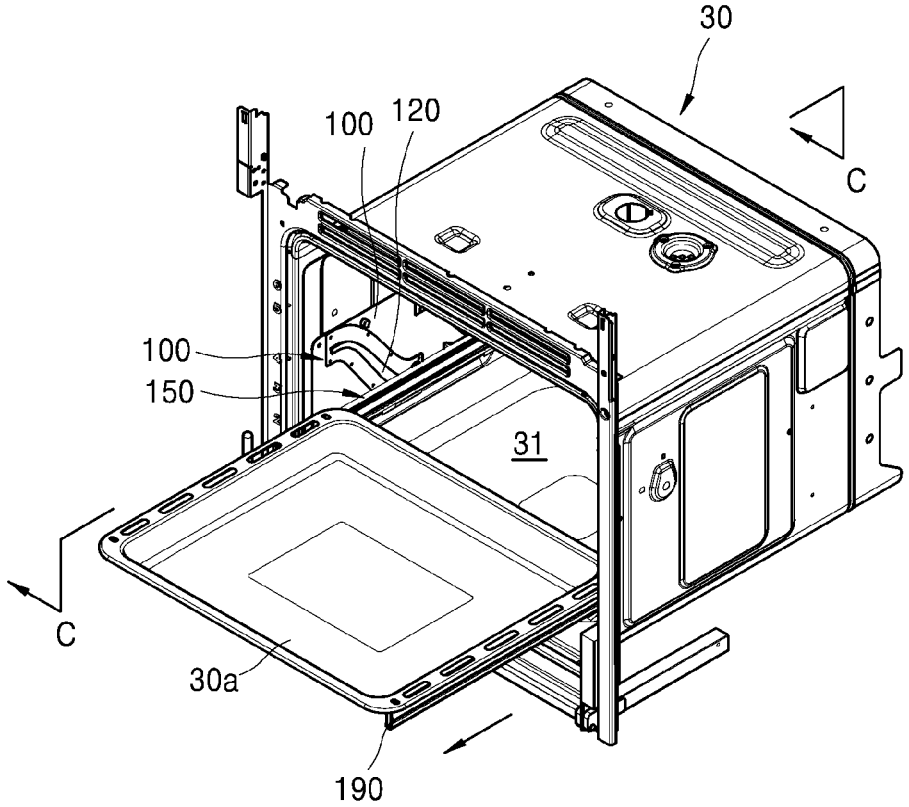
FIG. 10 is a diagram illustrating a primary withdrawal state of a shelf in the cooking appliance according to one embodiment of the present disclosure.
Figure 11:
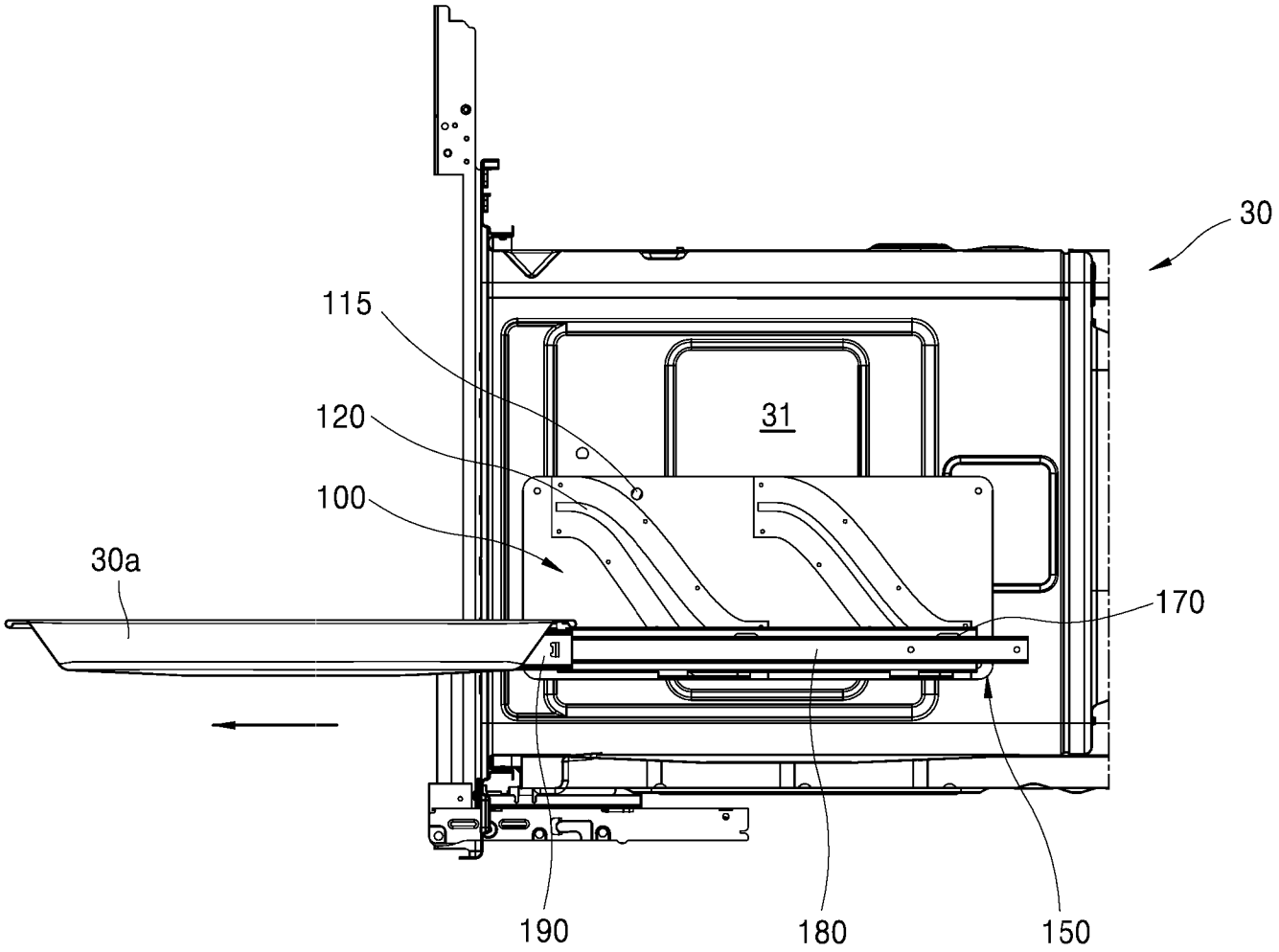
FIG. 11 is a cross-sectional view taken along line C-C of FIG. 10.
Figure 12:
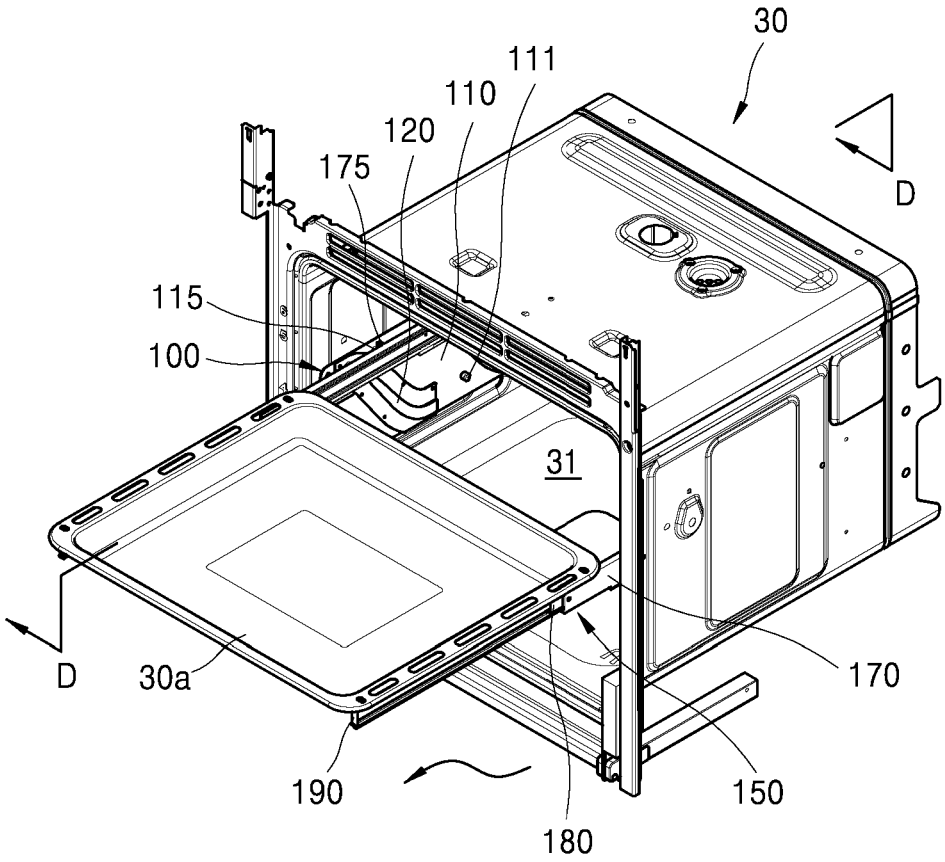
FIG. 12 is a diagram illustrating a secondary withdrawal state of the shelf illustrated in FIG. 10.
Figure 13:
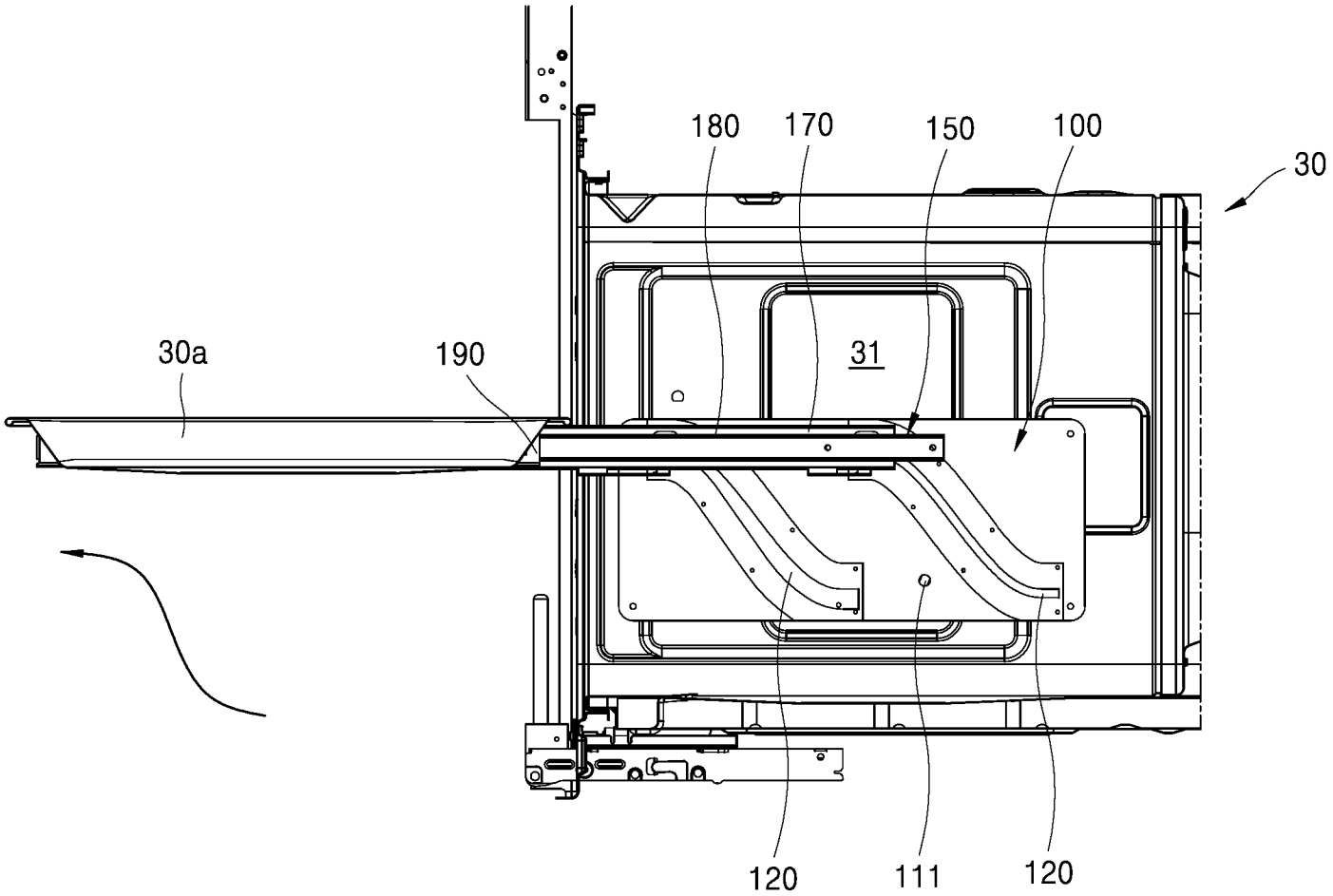
FIG. 13 is a cross-sectional view taken along line D-D of FIG. 12.

FIG. 10 is a diagram illustrating a primary withdrawal state of the shelf in the cooking appliance according to one embodiment of the present disclosure, and FIG. 11 is a cross-sectional view taken along line C-C of FIG. 10. Also, FIG. 12 is a diagram illustrating a secondary withdrawal state of the shelf illustrated in FIG. 10, and FIG. 13 is a cross-sectional view taken along line D-D of FIG. 12.

Hereinafter, an operation and an effect of the shelf support device according to the embodiment will be described with reference to FIGS. 3, 10, and 13.

Referring to 2 and 3, the shelf support device 100 of the present embodiment is installed inside the cooking chamber 31 to movably support the shelf 30*a*. At this point, each support assembly configuring the shelf support device 100 is configured such that the pair of rails 120 are installed at the fixing plate 110, and the support unit 150 is movably coupled to the pair of rails 120 installed as described above, thereby being installed at each of the left side surface and the right side surface inside the cooking chamber 31.

As another example, each support assembly may be provided in a form in which the pair of rails 120 is directly installed at each of the side surfaces inside the cooking chamber 31 without the fixing plate 110. In this case, a component corresponding to the fixing plate 110 mat be removed, and thus an effect of reducing the number of components of the shelf support device 100 may be provided.

In the present embodiment, a case, in which the pair of rails 120 are installed at the fixing plate 110, and the fixing plate 110 at which the pair of rail 120 is fixed to each of the side surfaces of the cooking chamber 31, is exemplified.

According to the installation structure of the rail 120 using the fixing plate 110, the following advantages are obtained.

First, compared to when the rail 120 is directly installed inside the cooking chamber 31, an alignment of the pair of rails 120 may be easily effectively achieved.

When each of the rails 120 is installed at the cooking chamber 31, since the rails 120 are installed in a state of extending the hand into a narrow space of the cooking chamber 31, an alignment between the rails 120 is very difficult.

According to the present embodiment, the pair of rails 120 are first installed at the fixing plate 110 and then the fixing plate 110 at which the pair of rails 120 are installed is fixed to each of the side surfaces of the cooking chamber 31, thereby accurately aligning the pair of rails 120 such that the alignment of the pair of rails 120 is accurately performed as well as the installation of the pair of rails 120 may be more easily performed.

Second, the pair of rails 120 are installed at the fixing plate 110 and then the support unit 150 is coupled to each of the pair of rails 120 such that assembling of each support assembly may be completed outside the cooking chamber 31. Consequently, the shelf support device 100 may be provided as two group components including a pair of support assemblies, and the shelf support device 100 may be completely installed by fixing the fixing plate 110 of each support assembly only to each of the side surfaces of the cooking chamber 31, so that a component management becomes very easy, and costs and a time required to install the shelf support device 100 may be extremely effectively reduced.

The shelf 30*a* is mounted on the upper portion of the shelf support device 100 installed as described above, and, at the first position, the shelf 30*a* is maintained in a state in which the shelf 30*a* is completely inserted into the cooking chamber 31. In such a state, when the door in front of the cooking chamber 31 is open and the shelf 30*a* is pulled in the forward direction, as shown in FIGS. 10 and 11, the length of each of the pair of support units 150 extends to withdraw the shelf 30*a*. At this point, the extension of each of the support units 150 may be achieved such that the gliding supporter 190 is moved in the forward direction along the shelf 30*a*.

When the shelf 30*a* is further pulled in the forward direction in a state in which each of the support units 150 fully extends, as shown in FIGS. 12 and 13, the shelf 30*a* is withdrawn in a form in which the shelf 30*a* is simultaneously moved upward and forward.

The withdrawal of this type of the shelf 30*a* is achieved such that each of the support units 150 is moved in the forward direction along the movement path formed by the rail 120, and when each of the support units 150 is moved up to a position at which interference between the stopper 155 and the second blocking protrusion 115 occurs, a further movement of the support unit 150 is prevented and the position of the support unit 150 is maintained at the second position, thereby completing the withdrawal of the shelf 30*a* at the second position.

When the shelf 30*a* is withdrawn as described above, the shelf 30*a* is withdrawn to a position higher than that when the shelf 30*a* is inserted into the cooking chamber 31, so that the user may place food on the shelf 30*a* or take out the food therefrom at a convenient position for handling the food.

That is, according to the shelf support device 100 and the cooking appliance of the present embodiment, since the user may place the food on the shelf 30*a* and take out the food therefrom without excessively bending the waist, so that it is possible to reduce an adverse effect to the user's waist and the risk of a safety accident due to shifting of the center of gravity of the user to the hot cooking chamber 31.

When the shelf 30*a* is withdrawn as described above, the elastic force applied to the first wheel 160 and the second wheel 165 by the elastic support member 175 acts as a force for promoting the rolling of the first wheel 160 and the second wheel 165 toward the front side and the upper portion, so that the shelf 30*a* may be easily conveniently withdrawn even with a lesser force.

Meanwhile, when the shelf 30*a* is pushed back in a state in which the shelf 30*a* is withdrawn as described above, as shown in FIG. 3, the shelf 30*a* is inserted such that a descending movement and the backward movement of the shelf 30*a* are simultaneously performed.

The inserting of this type of the shelf 30*a* is achieved such that each of the support units 150 is moved in the backward direction along the movement path formed by the rail 120, and when each of the support units 150 is moved up to a position at which interference between the stopper 155 and the first blocking protrusion 111 occurs, a further movement of the support unit 150 is prevented and the position of the support unit 150 is maintained at the first position, thereby completing the inserting of the shelf 30*a* at the first position.

At this point, as the support unit 150 is moved in the backward direction, a greater resistance force is applied to the support unit 150, and thus deceleration of the support unit 150 is induced by the resistance force so that the inserting of the shelf 30*a* is achieved at a gentle speed. Consequently, in a state in which the impact caused by weights of the support unit 150, the shelf 30*a*, and the food placed on the shelf 30*a* is effectively alleviated, the inserting of the shelf 30*a* may be performed.

As an example, the inserting of the shelf 30*a* may be such that the extending length of the support unit 150 is first reduced, and then the support unit 150 is moved in the backward direction.

As another example, the inserting of the shelf 30*a* may be such that the support unit 150 is first moved in the backward direction, and then the extending length of the support unit 150 is reduced. Such inserting of the shelf 30*a* may be achieved by configuring the support unit 150 such that a frictional force between the guide rail frame 180 and the gliding supporter 190 when the support unit 150 is moved in the backward direction acts greater than that between the support unit 150 and the rail 120 when the length of the support unit 150 is reduced.

In accordance with the shelf support device and the cooking appliance with the same according to the present disclosure, the user may place food on the shelf or take out the food therefrom without excessively bending the waist so that there is an advantage capable of providing an improved convenience of use and stability by reducing an adverse effect to the user's waist or the risk that the center of gravity of the user is shifted toward the hot cooking chamber side to cause a safety accident.

In addition, the shelf support device 100 and the cooking apparatus with the same of the present embodiment allow the inserting of the shelf 30*a* to be performed at a gentle speed an thus the impact, which may be generated in the inserting of the shelf 30*a*, can be effectively alleviated, so that a loud noise due to the impact generated in the inserting of the shelf 30*a* can prevented from being generated or food placed on the shelf 30*a* can be prevented from escaping from the shelf 30*a* in advance.

While the present disclosure has been described with reference to the embodiments shown in the drawings, these embodiments are merely illustrative and it should be understood that various modifications and equivalent other embodiments can be derived by those skilled in the art on the basis of the embodiments. Accordingly, the technical scope of the present disclosure should be determined by the following claims.

What is claimed is:

1. A shelf support device comprising:

a rail that extends in a forward direction of the shelf support device and in a backward direction of the shelf support device and that has a front end portion located vertically above a rear end portion, the rail including an upper surface and a lower surface that define a movement path configured to guide movement of a shelf in the forward direction and the backward direction, the movement path being inclined upward to the front end portion; and a support unit that is configured to seat the shelf at an upper portion of the support unit, that is configured to couple to the rail, and that is configured to move along the movement path defined by the rail, wherein the support unit is further configured to:

based on the support unit moving in the forward direction along the movement path, move together with the shelf in an upward direction of the shelf support device, and based on the support unit moving in the backward direction along the movement path, move together with the shelf in a downward direction of the shelf support device, and wherein the support unit includes:

a first wheel configured to be positioned vertically above the rail and configured to roll along the upper surface of the rail, a second wheel located vertically below the first wheel and configured to roll along the lower surface of the rail, the rail being located between the first wheel and the second wheel, a moving member to which the first wheel and the second wheel are coupled, the moving member being configured to move along the movement path based on movement of at least one of the first wheel or the second wheel, and an elastic support member that is configured to support at least one of the first wheel or the second wheel, that is configured to enable the first wheel and the second wheel to contact the rail, and that is configured to provide elastic force to press at least one of the first wheel or the second wheel toward another of the first wheel or the second wheel.

2. The shelf support device of claim 1, wherein the rail further includes a side wall portion that protrudes vertically upward from the upper surface, that protrudes vertically downward from the lower surface, and that is configured to restrict lateral direction movement of each of the first wheel and the second wheel based on the rail being engaged with the first wheel and the second wheel, and wherein the rail has a rotated "T" shape cross-section in which the upper surface, the lower surface, and the side wall portion are connected to each other.

3. The shelf support device of claim 1, wherein the elastic support member includes a plate spring that extends in a length direction of the moving member, that has a first side coupled to the moving member and a second side coupled to the second wheel, and that is configured to deform in a vertical direction with respect to the first side coupled to the moving member.

4. The shelf support device of claim 1, wherein the rail includes a thickness variation section in which a distance between the upper surface and the lower surface increases toward the rear end portion of the rail.

5. The shelf support device of claim 1, further comprising a fixing plate at which the rail is configured to be installed.

6. The shelf support device of claim 5, wherein the fixing plate is configured to allow installation of a plurality of rails that are spaced apart from each other by an interval in the forward direction or the backward direction, wherein the first wheel includes a plurality of first wheels, and the second wheel includes a plurality of second wheels corresponding to the plurality of rails installed at the fixing plate, and wherein each first wheel and each second wheel are configured to couple to and roll along a rail of the plurality of rails.

7. The shelf support device of claim 5, further comprising a movement restriction part configured to limit movement of the support unit outside of a set position.

8. The shelf support device of claim 1, wherein the moving member includes:

a wheel frame at which the first wheel and the second wheel are installed, the wheel frame being configured to move along the movement path based on movement of at least one of the first wheel or the second wheel;

a guide rail part that is configured to extend in the forward direction and the backward direction relative to the wheel frame and that is coupled to the wheel frame; and a gliding supporter that is configured to seat the shelf vertically above the gliding supporter and that is configured to move in the forward direction and the backward direction relative to the guide rail part.

9. The shelf support device of claim 8, wherein the moving member further includes a mounting protrusion located at an upper surface of the gliding supporter and configured to couple the shelf to the gliding supporter.

10. The shelf support device of claim 1, wherein the moving member includes:

a first moving member that is configured to couple to a first side of the shelf; and a second moving member that is configured to couple to a second side of the shelf and that extends in a direction parallel to the first moving member.

11. The shelf support device of claim 1, wherein the elastic support member is configured to provide the elastic force to enable the first wheel to contact the upper surface of the rail and to enable the second wheel to contact the lower surface of the rail.

12. A shelf support device comprising:

a rail that extends in a forward direction of the shelf support device and in a backward direction of the shelf support device and that has a front end portion located vertically above a rear end portion, the rail including an upper surface and a lower surface that define a movement path configured to guide movement of a shelf in the forward direction and the backward direction, the movement path being inclined upward to the front end portion;

a fixing plate at which the rail is configured to be installed;

a support unit that is configured to seat the shelf at an upper portion of the support unit, that is configured to couple to the rail, and that is configured to move along the movement path defined by the rail; and a movement restriction part configured to limit movement of the support unit outside of a set position, wherein the support unit is further configured to:

based on the support unit moving in the forward direction along the movement path, move together with the shelf in an upward direction of the shelf support device, and based on the support unit moving in the backward direction along the movement path, move together with the shelf in a downward direction of the shelf support device, wherein the support unit includes:

a first wheel configured to be positioned vertically above the rail and configured to roll along the upper surface of the rail, a second wheel located vertically below the first wheel and configured to roll along the lower surface of the rail, the rail being located between the first wheel and the second wheel, and a moving member to which the first wheel and the second wheel are coupled, the moving member being configured to move along the movement path based on movement of at least one of the first wheel or the second wheel, wherein the movement restriction part includes:

a stopper that protrudes from a side of the support unit and that faces the fixing plate, a first protrusion that protrudes from a side of the fixing plate, that faces the support unit, and that is configured to, based on interfering with the stopper, restrict movement of the support unit from a first position in the backward direction, and a second protrusion that protrudes from the side of the fixing plate, that faces the support unit, and that is configured to, based on interfering with the stopper, restrict movement of the support unit in the forward direction from a second position that is located forward of the first position, and wherein the second protrusion is located forward of the first protrusion.

13. A cooking appliance comprising the shelf support device of claim 12.

14. A cooking appliance comprising:

a body that defines a cooking chamber;

a shelf located in the cooking chamber, and a shelf support device located at the cooking chamber and configured to support the shelf, wherein the shelf support device includes:

a rail that extends in a forward direction of the cooking chamber and in a backward direction of the cooking chamber and that has a front end portion located vertically above a rear end portion, the rail including an upper surface and a lower surface that define a movement path configured to guide movement of the shelf in the forward direction and the backward direction, the movement path being inclined upward to the front end portion, and a support unit that is configured to seat the shelf at an upper portion of the support unit, that is configured to couple to the rail, and that is configured to move along the movement path, wherein the support unit is further configured to:

based on the support unit moving in the forward direction along the movement path, move together with the shelf in an upward direction of the cooking chamber, and based on the support unit moving in the backward direction along the movement path, move together with the shelf in a downward direction of the cooking chamber, and wherein the support unit includes:

a first wheel configured to be positioned vertically above the rail and configured to roll along the upper surface of the rail, a second wheel located vertically below the first wheel and configured to roll along the lower surface of the rail, the rail being located between the first wheel and the second wheel, a moving member to which the first wheel and the second wheel are coupled, the moving member being configured to move along the movement path based on movement of at least one of the first wheel or the second wheel, and an elastic support member that is configured to support at least one of the first wheel or the second wheel, that is configured to enable the first wheel and the second wheel to contact the rail, and that is configured to provide elastic force to press at least one of the first wheel or the second wheel toward another of the first wheel or the second wheel.

15. The cooking appliance of claim 14, wherein the shelf support device further includes a fixing plate to which the rail is configured to couple, wherein the support unit is configured to couple to the rail that is coupled to the fixing plate, and wherein the support unit comprises a first support unit that is configured to couple to a first side of the cooking chamber and a second support unit that is configured to couple to a second side of the cooking chamber and that faces toward the first support unit.

16. The cooking appliance of claim 14, wherein the moving member includes:

a wheel frame at which the first wheel and the second wheel are installed, the wheel frame being configured to move along the movement path based on movement of the first wheel and movement of the second wheel;

a guide rail part that is configured to extend in the forward direction and the backward direction relative to the wheel frame and that is coupled to the wheel frame; and a gliding supporter that is configured to seat the shelf vertically above the gliding supporter and that is configured to move in the forward direction and the backward direction relative to the guide rail part.

17. The cooking appliance of claim 14, wherein the moving member includes:

a first moving member that is configured to couple to a first side of the shelf that faces the first side of the cooking chamber; and a second moving member that is configured to couple to a second side of the shelf that faces the second side of the cooking chamber, the second moving member extending in a direction parallel to the first moving member.

18. The cooking appliance of claim 15, wherein the rail includes a first rail coupled to the first side of the cooking chamber and a second rail coupled to the second side of the cooking chamber.

19. The cooking appliance of claim 16, wherein the moving member further includes a mounting protrusion located at an upper surface of the gliding supporter and configured to couple the shelf to the gliding supporter.

* * * * *